United States Patent [19]

Pollmeier et al.

[11] Patent Number: 4,602,579

[45] Date of Patent: Jul. 29, 1986

[54] APPARATUS FOR TENSIONING AND CONTROLLED ADVANCING OF A TUBE-LIKE SEWING ARTICLE

[75] Inventors: Konrad Pollmeier, Bielefeld; Philipp Moll; Wolfgang Goebbels, both of Aachen, all of Fed. Rep. of Germany

[73] Assignee: Durkoppwerke GmbH, Bielefeld, Fed. Rep. of Germany

[21] Appl. No.: 657,346

[22] Filed: Oct. 3, 1984

[30] Foreign Application Priority Data

Oct. 4, 1983 [DE] Fed. Rep. of Germany ..... 3335936

[51] Int. Cl.[4] ..... D05B 21/00; D05B 23/00

[52] U.S. Cl. ..... 112/121.26; 112/121.27

[58] Field of Search ..... 112/121.26, 121.13, 112/121.27, 312, 313, 309, 304, 322, 121.12; 198/855

[56] References Cited

U.S. PATENT DOCUMENTS

| | | | |
|---|---|---|---|
| 1,723,781 | 8/1929 | Hoggard | 112/121.26 |
| 3,315,624 | 4/1967 | Lebovic et al. | 112/262.3 |
| 3,443,533 | 5/1969 | Posey et al. | 112/2 |
| 3,736,895 | 6/1973 | Farrar et al. | 112/147 |
| 3,865,058 | 2/1975 | Rovin et al. | 116/121.26 |
| 4,046,087 | 9/1977 | Manetti | 112/121.26 |
| 4,098,201 | 7/1978 | Adamski, Jr. et al. | 112/121.26 |
| 4,137,857 | 2/1979 | Miyachi et al. | 112/121.27 |
| 4,147,120 | 4/1979 | Adamski, Jr. et al. | 112/121.26 |
| 4,185,570 | 1/1980 | Kleinschmidt et al. | 112/121.27 |
| 4,473,017 | 9/1984 | Letard et al. | 112/121.26 |

FOREIGN PATENT DOCUMENTS

| | | |
|---|---|---|
| 2740780 | 3/1978 | Fed. Rep. of Germany . |
| 2514794 | 12/1979 | Fed. Rep. of Germany . |
| 3121118 | 3/1982 | Fed. Rep. of Germany . |
| 3142836 | 10/1983 | Fed. Rep. of Germany . |
| 650483 | 1/1929 | France . |

*Primary Examiner*—Werner H. Schroeder
*Assistant Examiner*—Joseph S. Machuga
*Attorney, Agent, or Firm*—Karl F. Ross; Herbert Dubno

[57] ABSTRACT

An apparatus for tensioning and controlled advancing of tube-like articles includes at least one stationary roller and a non-stationary roller which is movable by a slider in order to tension the waist of an article pulled over the rollers. Depending on the position of the slider when having tensioned the article, the speed of one of the rollers is controlled to allow the sewing of belt loops in controlled distances onto the article.

14 Claims, 16 Drawing Figures

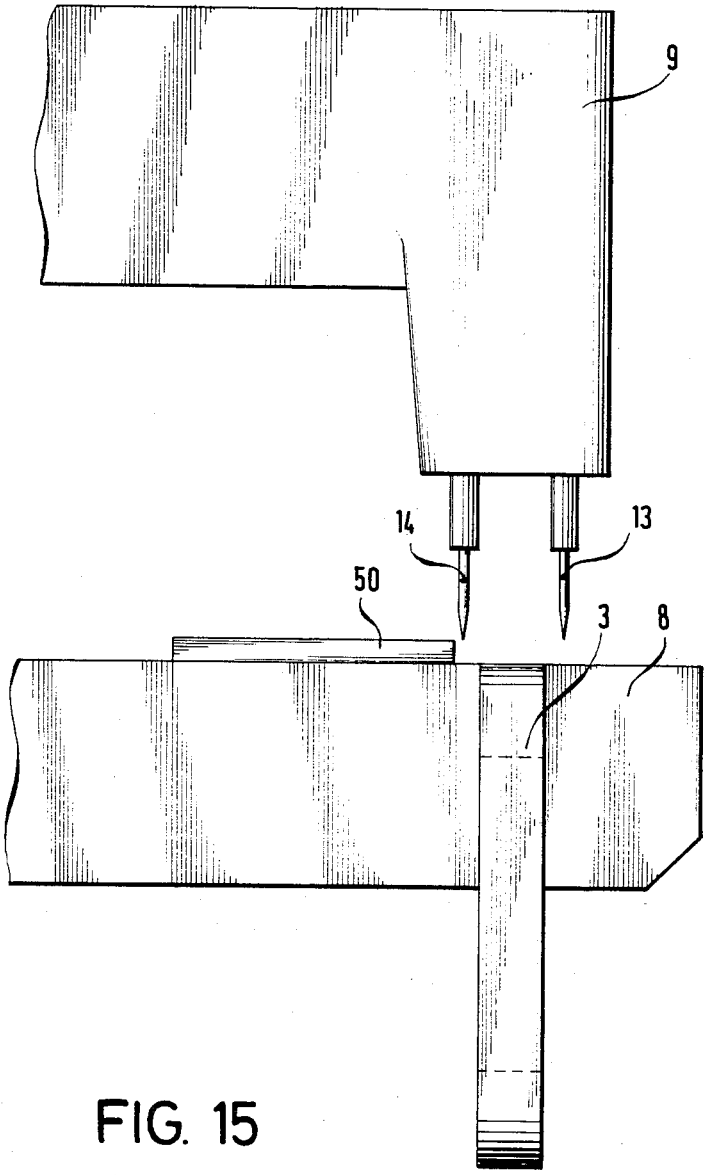
FIG. 15
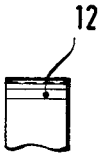

APPARATUS FOR TENSIONING AND CONTROLLED ADVANCING OF A TUBE-LIKE SEWING ARTICLE

CROSS REFERENCE TO RELATED APPLICATIONS

This application is related to commonly assigned copending application Ser. No. 597,448 filed Apr. 6, 1984, now U.S. Pat. No. 4,530,294, granted July 23, 1985, and corresponding German application P No. 33 12 317.9 which with German application P No. 33 35 936.9 of Oct. 4, 1983 are hereby incorporated by reference.

FIELD OF THE INVENTION

Our present invention relates to an apparatus for tensioning and controlledly advancing tube-like sewing articles with respect to a sewing machine and especially for sewing waistbands with or without belt loops on garments.

BACKGROUND OF THE INVENTION

From the German Pat. No. 25 14 794, there is known a sewing machine which is provided with an apparatus for sewing on an endless ribbon to a tube-like article. The article is advanced over a plurality of rollers arranged transversely to the advancing direction and whose axes can be varied in their distance. At least one of the rollers is driven by respective means. This apparatus in connection with the sewing machine provides an exact overlapped sewing of an endless ribbon on the article which is of low elasticity and allows an adjustment to articles of varying waist sizes.

The apparatus of this patent does not, however, permit an automatic adjustment of the transport of the article depending on the respective position of the non-stationary roller to compensate the different waist sizes of the articles. Moreover, this apparatus does not provide a temporary transport for advancing of the article.

German open application DE-OS No. 31 42 836 describes a sewing machine equipped with a tensioning apparatus for tube-like articles in which a stationary and a non-stationary tension roller is used. The non-stationary roller is supported on a lever with a counterbalance weight dimensioned in such a manner that an indifferent state is obtained on the lever. This apparatus does also lack the automatic adjustment of the advancing motion of the article in dependence on the respective position of the non-stationary roller.

German patent application P No. 33 12 317.9 and the above-mentioned U.S. Pat. No. 4,530,294 describe a sewing machine with a tension apparatus which includes a tension drum provided with at least three tension segments movable relative to the center of the tension drum. Since the drum must be arranged in front of the pressing foot of the sewing machine, it is not possible to stretch the tube-like article in immediate vicinity of the portion of the article to be sewed.

OBJECT OF THE INVENTION

It is thus the object of our present invention to provide an improved apparatus for tensioning and controlled advancing of tube-like articles obviating the aforestated drawbacks.

SUMMARY OF THE INVENTION

We realize this object, in accordance with the present invention, by providing a slider which moves the non-stationary rollers relative to the stationary rollers to tension the article wherein the respective position of the slider after tensioning the article is transmitted to control means which drives one of the rollers intermittently in dependence on the position of the slider.

Through the provision of an apparatus according to the invention, it is possible to obtain an essentially automatic sewing of e.g. waistbands and belt loops onto tube-like articles like pants or skirts having varying waist sizes whereby the distance between subsequent belt loops is automatically adjusted depending on the specific waist size. The operator is only required to pull the article over the rollers and to remove the article after the sewing has been completed.

According to a further feature of the invention, the slider is connected via a four-bar crank gear to a control gear which drives the one roller in dependence on the position of the slider. Thus the input speed of the shaft connecting the control gear with an associated electromotor is geared to provide an output speed which depends on the position of the slider. Instead of using mechanical means, the position of the slider can also be detected by electronic means to provide the advancement of the article by the driven roller. Accordingly, the position of the slider is detected by a displacement transducer providing corresponding values which are converted by a microcomputer into rotation-angle values for the electromotor for controlling the latter in correspondence with the rotation-angle values.

BRIEF DESCRIPTION OF THE DRAWING

The above and other features of our present invention will now be described in detail with reference to the accompanying drawing in which:

FIG. 15 is a simplified side view of a two-needle sewing machine; and

SPECIFIC DESCRIPTION

Figure 11:
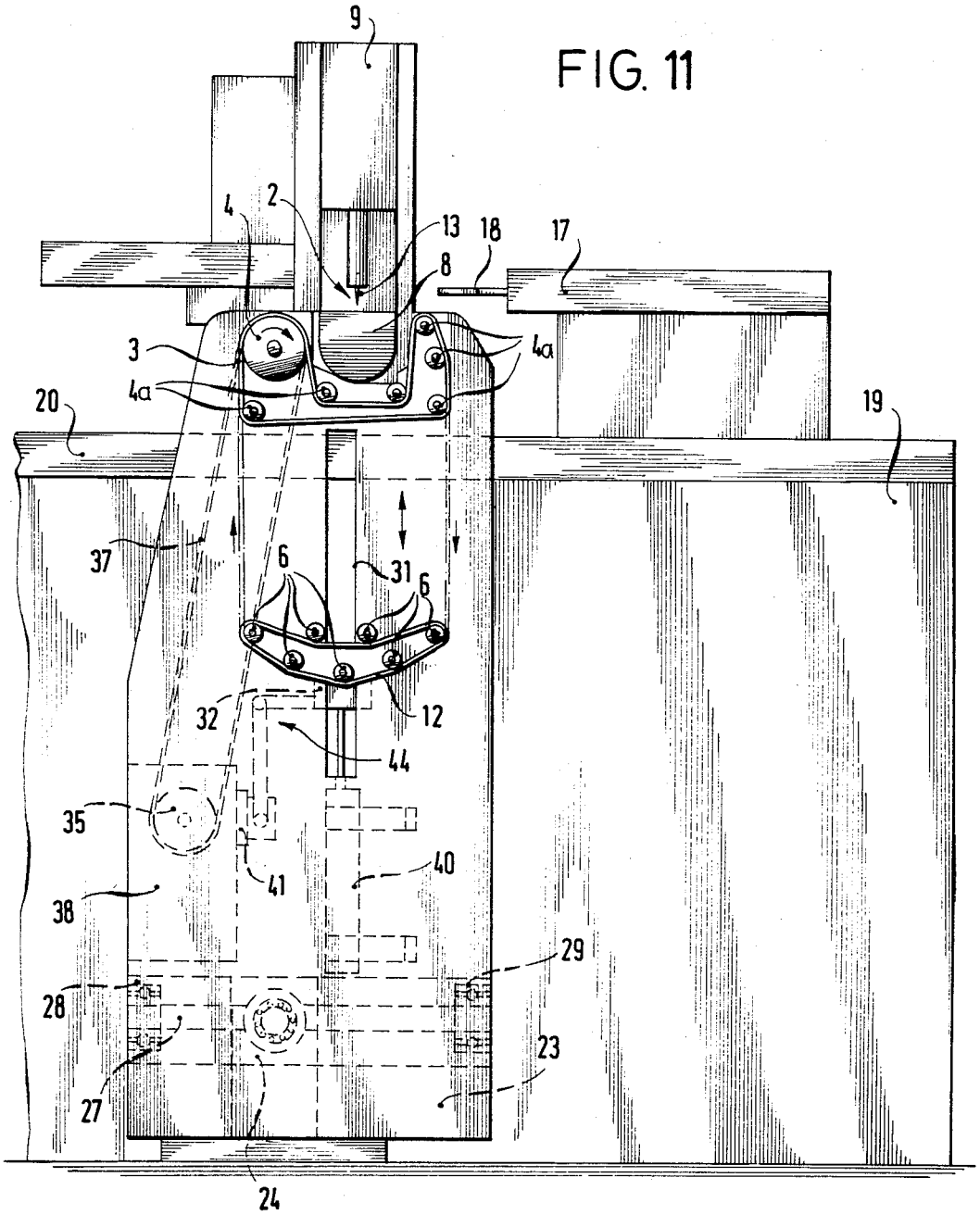
FIG. 11 is a front view of the third embodiment of the apparatus according to the invention taken along line C–D in FIG. 12.
Figure 12:
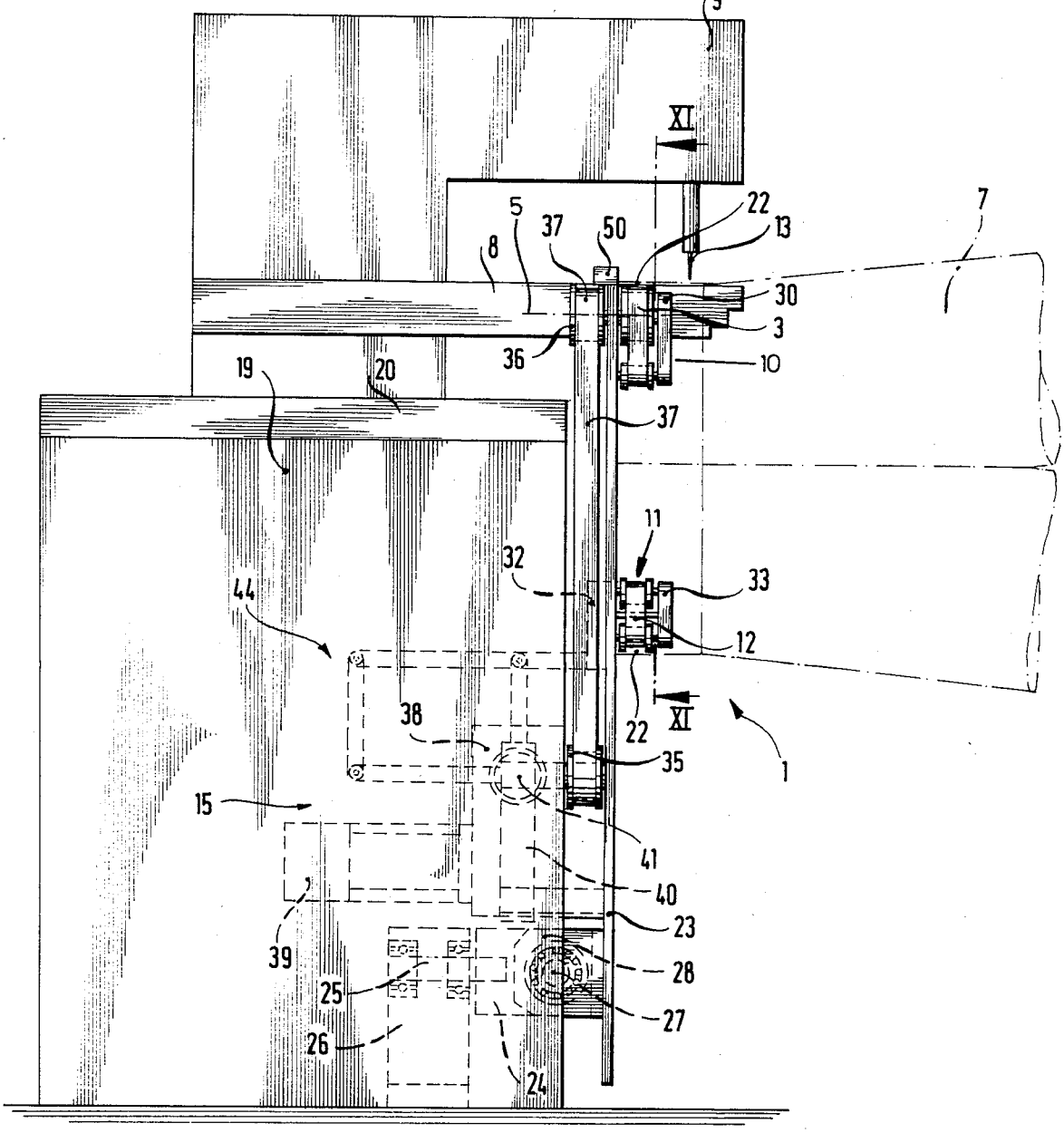
FIG. 12 is a side view of the apparatus shown in FIG. 11.

Referring firstly to FIGS. 11 and 12, there may be seen a sewing machine 9, preferably a conventional short seam machine with double lock stitch, which is provided with at least one sewing needle 13. Cooperating with the sewing machine 9 is a loop feeding device 17 of a design known per se and mounted with the sewing machine 9 on a work plate 20 of a frame 19. The loop feeding device 17 is charged with a prefinished rolled up loop ribbon and is provided with a slider (not shown) which shifts the forward end of the looped ribbon against an adjustable stop (not shown). A cutting device (not shown) associated to the feeding device 17 severs a loop portion of predetermined length from the loop ribbon.

Figure 16:
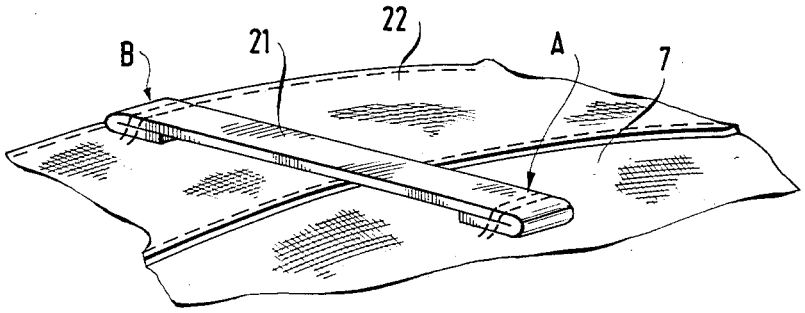
FIG. 16 illustrates a belt loop sewed on the waist portion of a tube-like article.

Projecting from the loop feeding device 17 are folding fingers 18 which engage the loop portion to fold downwardly both ends of the loop portion. Thus, a belt loop 21 is prepared which is laterally positioned under a pressure foot 8 of the sewing machine 9 and arranged on an article 7 to be sewed like e.g. pants or a skirt. The article 7 which is illustrated in FIG. 16 is arranged on an apparatus which is generally characterized by reference numeral 1 and is provided to tension and advance the article 7 so as to be provided with belt loops 21 which are accurately sewed on and uniformly spaced along the waistband depending on the waist size.

The apparatus 1 is shown in various embodiments in FIGS. 1–13 differing from each other in the manner in which the article 7 is engaged and advanced as will be explained hereinafter. Turning firstly to the embodiment shown in FIGS. 11 and 12, it can be seen that the apparatus 1 includes a first conveyor arrangement 10 in vicinity of the sewing area 2 and having a stationary driving pulley 4 and a plurality of stationary rollers 4*a* around which a belt 3 is strapped. Located below the first conveyor arrangement 10 is a second conveyor arrangement 11 which is movable towards or away from the sewing area 2 and includes a plurality of rollers 6 around which a conveyor belt 12 is strapped. In view of the vertical movement of the second conveyor arrangement 11, tube-like articles like pants or skirts with varying waist sizes can be tensioned after being positioned over the belts 3 and 12.

Figure 1:
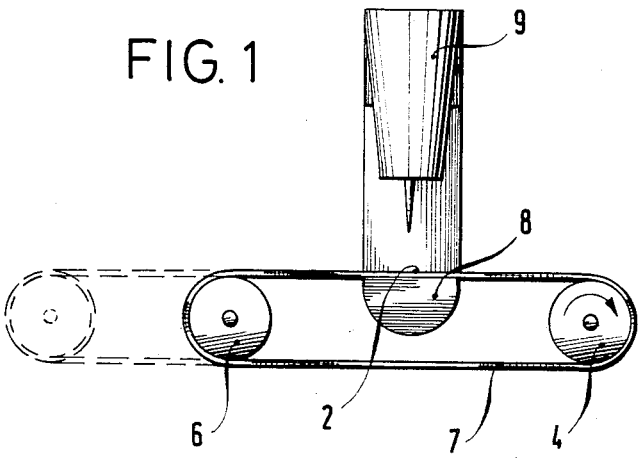
FIG. 1 is a simplified front view of a first embodiment of an apparatus according to the invention in which an article is directly positioned over a non-stationary roller and a stationary driving pulley.
Figure 2:
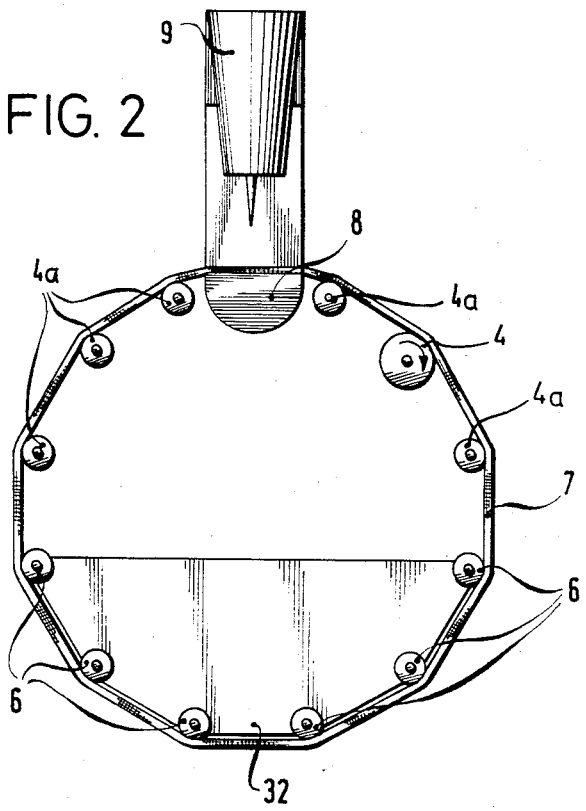
FIG. 2 is a further simplified front view of the embodiment of FIG. 1 in which a plurality of stationary rollers and non-stationary rollers as well as a stationary driving pulley are used.
Figure 6:
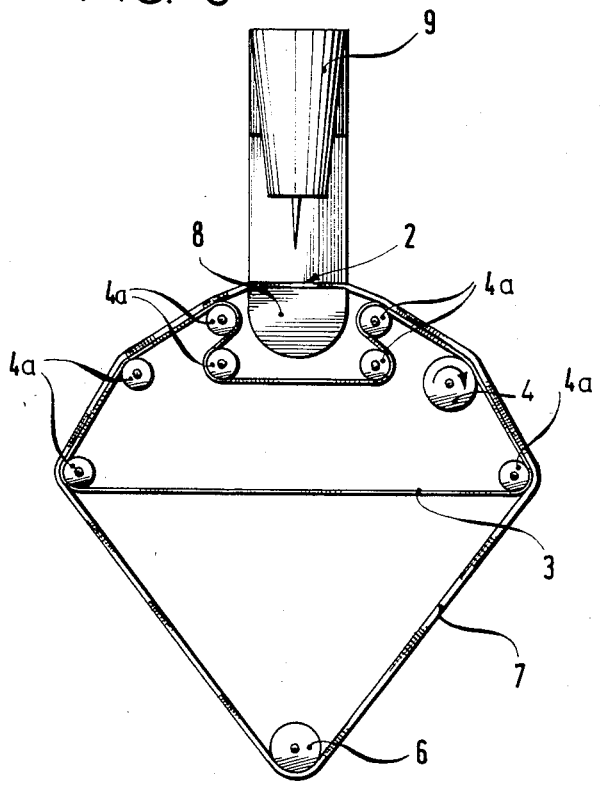
FIG. 6 is a simplified front view of a third embodiment of the apparatus according to the invention.
Figure 7:
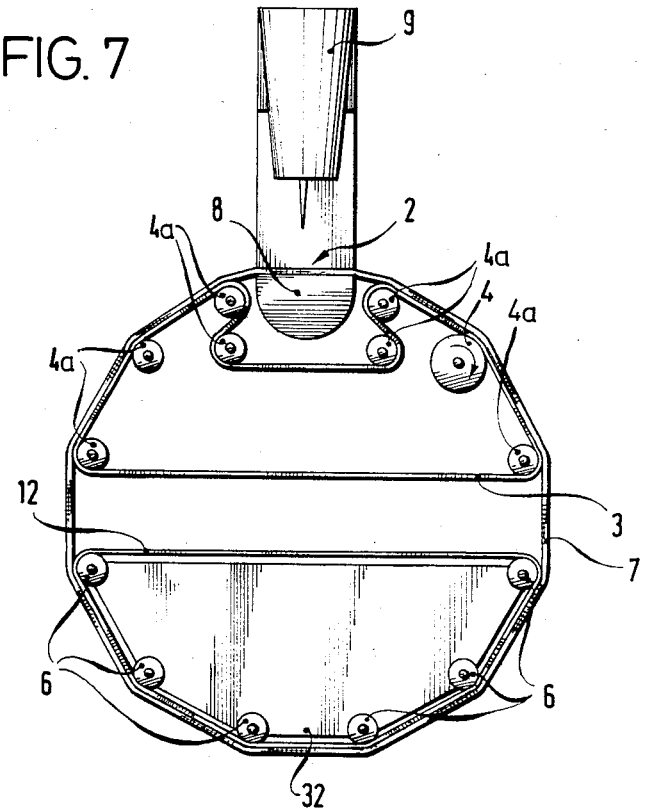
FIG. 7 is a simplified front view of a fourth embodiment of the apparatus according to the invention.
Figure 8:
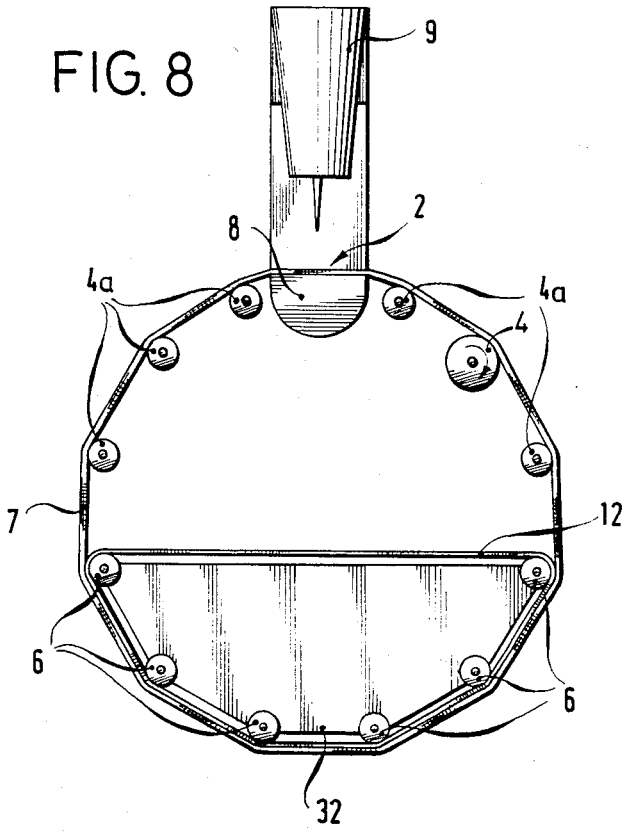
FIG. 8 is a simplified front view of a fifth embodiment of the apparatus according to the invention.

In the embodiment according to FIGS. 11 and 12, the conveyor arrangements 10, 11 each includes a plurality of rollers and a conveyor belt. It is, however, also possible to omit the conveyor belts 3 and 12 as illustrated in FIGS. 1 and 2 so that the article 7 is directly arranged either around at least one driving pulley 4 and at least one roller 6*a* or around a plurality of rollers 4*a*, driving pulley 4 and a plurality of rollers 6. Further it is feasible to provide only one conveyor belt e.g. belt 3 as in FIG. 3 which is strapped around the stationary rollers 4 and movable rollers 6 (see also FIG. 5). In addition, as shown in FIG. 6, a conveyor belt 3 is provided along the rollers 4*a* and driving pulley 4 so that the article 7 is arranged over the conveyor belt 3 and simultaneously over at least one roller 6, or vice versa as illustrated in FIG. 8 in which the conveyor belt 12 extends along the rollers 6 while the article 7 lies directly over the rollers 4*a* and pulley 4. In summary, we may note that any number of stationary rollers and non-stationary rollers in combination with or without conveyor belts 3, 12 is possible according to the invention.

For providing the drive of the conveyor arrangement 10 and the movement of the conveyor arrangement 11, the apparatus 1 includes a carrier plate 23 to whose lower portion a stand 24 is mounted. The stand 24 supports one end of a gudgeon 25 whose remaining portion which projects beyond the stand 24 away from the plate 23 is supported in a friction-free manner in a bearing block 26 which is fixed to the frame 19 by any suitable means. Extending perpendiculary to the gudgeon 25 is an axle 27 which is fixedly connected to the stand 24 and whose opposing ends are supported in a friction-free manner, e.g. through ball bearings, in bearing blocks 28, 29 respectively spaced from each other in horizontal direction of the plate 23 and fixed to the latter. Consequently, the plate 23 can be pivoted around the axis defined by the gudgeon 25 and around the axle 27. The plate 23 follows the movement of the article 7 during the sewing step by pivoting about the axis 25. After terminating the sewing, the plate 23 is returned into its initial position by a not shown operating cylinder. Pivoting about the axle 27 is necessary to sew one end of the belt loop—e.g. seam A—and then the other end B to the article (FIG. 16). Thus when the sewing needle 13 is in its elevated position, the plate 23 can be pivoted towards the needle 13 to allow sewing of the seam B. In this connection, we may note that the sewing machine 9 directly controls the pivoting of the plate 23 about the axle 27 by means known per se.

The stationary rollers 4*a* are pivotally supported by gudgeons in a known manner as indicated in dash-dot lines 5 in FIG. 12. The gudgeons 5 are fixedly connected to the plate 23 with one end thereof while its other end supports a plate 30. The driven pulley 4 is also pivotally supported by a gudgeon which is fixed to the plate 23 and whose one end projecting beyond the plate 23 supports a belt pulley 36.

Arranged within the plate 23 is a longitudinal slot 31 in which a member 32, e.g. a slider, is movable upwardly and downwardly and guided in a form-locking manner. Connected to the member 32 are gudgeons—indicated by dotted line 6*b* in FIG. 13—by which the rollers 6 are pivotally supported and whose other end supports a plate 33. The member 32 communicates with a double-acting operating cylinder 40 in which a pressure medium is admitted to move the member 32 along the slot 31 in direction towards or away from the sewing area 2. Thus, when an article 7 of any arbitrary waist size is pulled over the rollers 4, 4*a*, 6, the member or slider 32 will move away from the sewing area and thus from the upper rollers 4*a* so that the article 7 is tensioned. At the top, the plate 23 is further provided with a laterally movable stop 50 so that the article 7 can be positioned with respect to the rollers and the sewing area in an appropriate manner since the stop 50 will limit the positioning of the article 7.

Figure 13:
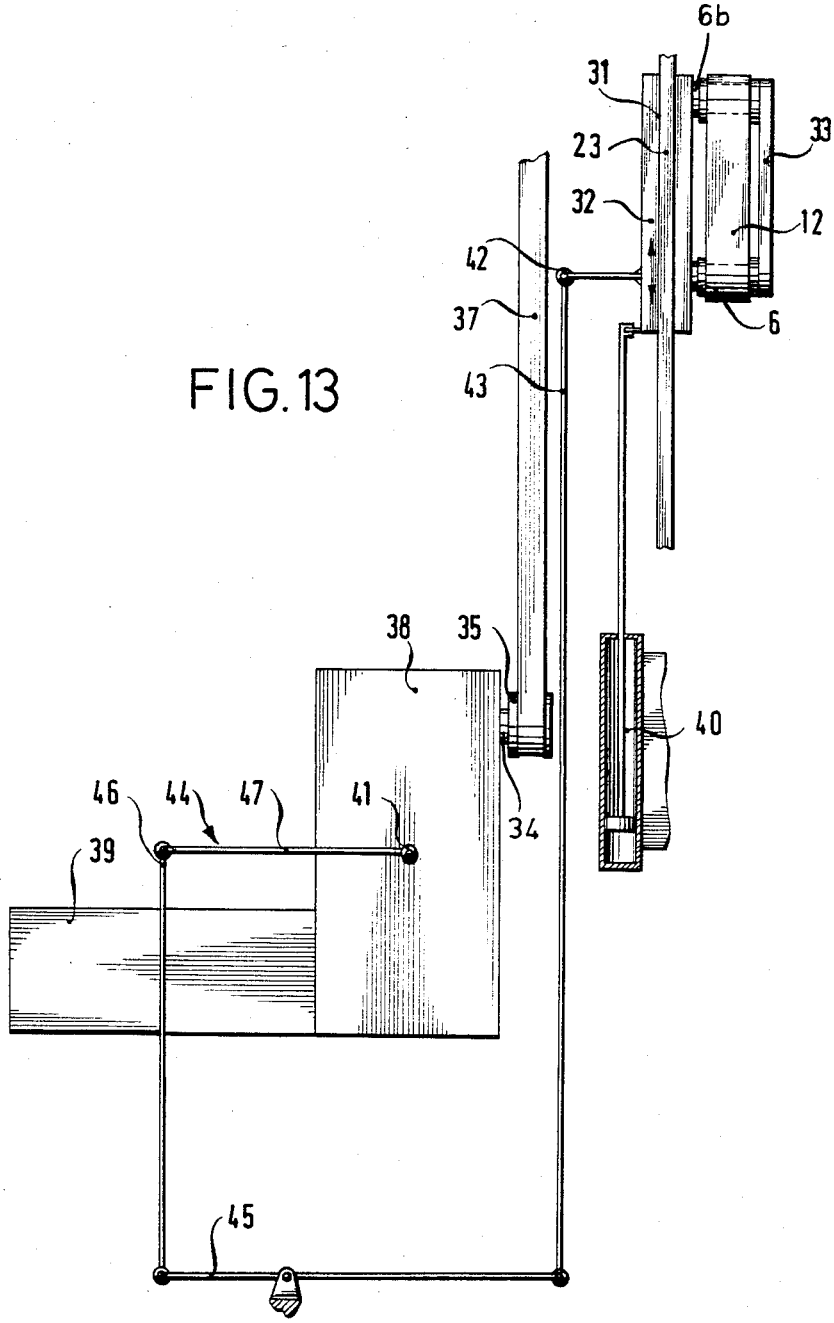
FIG. 13 is a principal illustration of a control unit used in connection with the apparatus according to the invention.

For controlling the movement of the driving pulley 4, the apparatus includes a control unit 15 which consists of a control gear 38, a crank gear 44 and an electromotor 39 which is equipped with an angle encoder. The conventional control gear 38 is connected to the plate 23 and has fixedly associated to the electromotor 39 a primary shaft which rotates with an input speed of 1450 rpm. The control gear 38 transmits the input speed into a lower output speed for the output shaft whose shaft end 34 is fixedly connected to a belt pulley 35. Around the belt pulleys 35 and 36, a belt 37 is strapped so that the output speed is transmitted to the driving pulley 4. Thus, the conveyor belt 3 and the article 7 or in case when no conveyor belt is used, the article 7 itself is temporarily moved by the control unit 15 while the unit 15 simultaneously controls the advancement of the conveyor belt 3 and/or article 7 in dependance on the relative position of the slider 32 which means that the advancement of the belt 3 and/or article 7 is directly proportional to the size of the waist of the article. It is thus essential that the control gear 38 permits a different output speed within a defined range upon constant input speed. Accordingly, the control gear 38 is provided with a shaft end 41 which is fixed to a crank 47 (FIG. 13). Hinged to the crank 47 is one end of a connecting rod 46 whose other end is hinged to a double-armed rocker 45. The free end of the rocker 45 is connected to the slider 32 via a lever 43 and a joint 42. The four-bar crank gear 44 defined by the crank 47, the rod 46 and the rocker 45 makes it feasible to transmit the shifting of the slider 32 onto the crank 47 to provide a corresponding rotation thereof. The control gear 38 is so dimensioned kinematically that a linear changement of the output speed from 54 rpm to 124 rpm is possible when the shaft end 41 is turned about 30 degrees. Therefore, in case an article 7 is sewed having a larger waist, the advancement of the conveyor belt 3 and/or the article 7 is automatically increased in the same proportion so that the belt loops have a distance from each other automatically adjusted according to the size of waist of the article 7.

Figure 14:
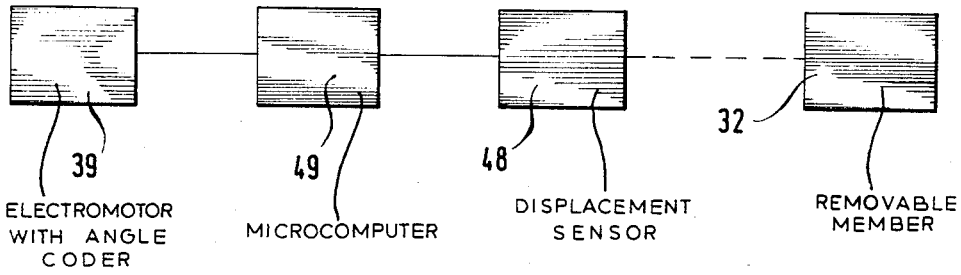
FIG. 14 is a block diagram of an electronic control unit used in connection with the apparatus according to the invention.

Instead of the described mechanic means to control the advancement of the conveyor belt 3 and/or article 7 in dependance on the waist size of the tube-shaped article 7, electronic means can be utilized as illustrated in FIG. 14. Thus, the movement of the slider 32 is detected by a conventional displacement transducer 48 whose measurements are converted by a microcomputer 49 in angle of rotation values for the electromotor 39 which is controlled accordingly.

Figure 3:
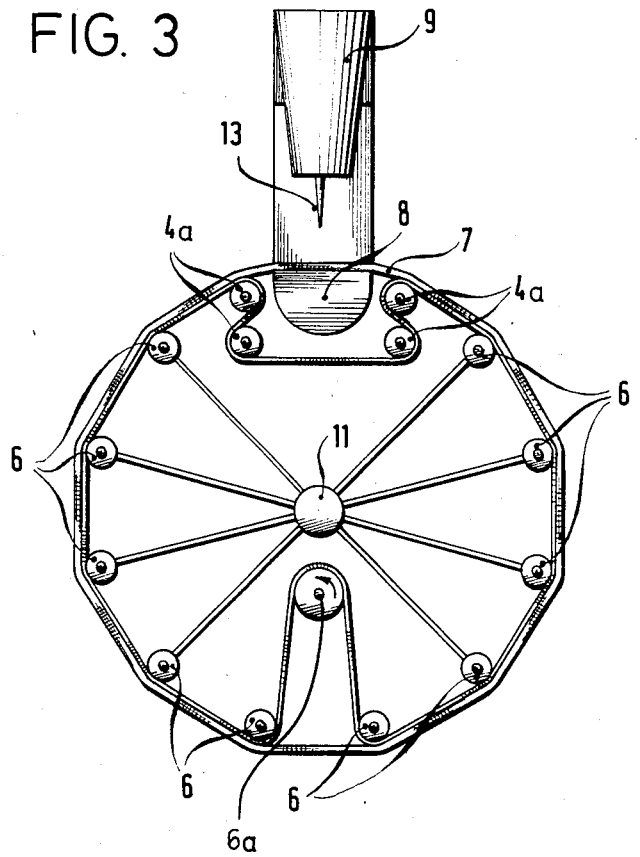
FIG. 3 is a simplified front view of a second embodiment of the apparatus in which the non-stationary rollers are movable to a reference point.

In this connection, we may note that the slider 32 can be connected to any number of rollers 6 and may be connected to a driving pulley 6*a* shown in FIG. 3. In the latter case the provision of the driving pulley 4 can be omitted. In the embodiment as shown in FIG. 3, the rollers 6 are movable radially relative to a reference point 11.

After having described the individual parts of the apparatus we will now explain the mode of operation.

A tube-like article 7, e.g. pants or a skirt, is positioned over the first and second conveying arrangements 10, 11 which may include any number of rollers and pulleys and may or may not include respective conveyor belts, and is located appropriately under the ventilated pressure foot 8. To guarantee an exact sewing of the belt loops 21 on the desired spot along the waist, the article 7 must be aligned during its positioning over the conveying arrangements 10, 11 in such a manner that a point of reference on the article 7 e.g. the center seam of the pants is in alignment with a marker, preferably an indicator, arranged e.g. on the plate 23. After positioning of the article 7, a pressure medium is introduced into the cylinder 40 so that the slider 32 moves away from the sewing area 2 and thus forces the conveying arrangement 11 downwardly to stretch or tension the article 7. We may note that the dimension of the slot 31 and the slider 32 allow the stretching of articles of any waist size. In order to prevent an interference with the sewing action, the adjustment to the different waist sizes of articles to be sewed is always provided in such a manner that the slider 32 and thus the arrangement 11 acts on the article at a location opposite to the sewing area 2 so that the part of the article 7 on which the belt loop is sewed remains correctly positioned.

The article 7 has now been accurately positioned and tensioned so that the actual sewing step of the belt loop can take place which has been previously folded by the feeding device 17 and is arranged under the pressure foot 8. The movement of the slider 32 to tension the article 7 has been transmitted to the crank 47 and the shaft end 41 so that the advancement of the driving pulley 4 (or 6*a* as in the embodiment of FIG. 3) to transport the article 7 is controlled and the belt loops 21 can be provided at exact distances and in a predetermined number.

At first, the seam A as shown in FIG. 16 is sewed and then the plate 23 is pivoted clockwise while the sewing needle is in its elevated position so as to sew the seam B. Thereafter, the needle 13 is elevated again and the plate 23 is returned into its initial position. When both seams A, B have been provided to fix the belt loop 21 onto the article 7, the electromotor is actuated and causes the control gear 38 and the driven pulley 4 to execute such a number of revolutions which corresponds to the waist size of the stretched article 7. Consequently, the article 7 is transported until the control sewing area for the subsequent belt loop 21 to be sewed onto the article is provided. The advancement of the article 7 corresponds therefore to the distance between loops 21 to be provided along the waist which distance is dependent on and automatically adjusted to the waist size of the article. After all the belt loops 21 have been sewed on the article 7, the slider is moved in direction towards the sewing area to loosen the article 7 and to allow the removal of the latter. A further sewing article can now be supplied.

Figure 4:
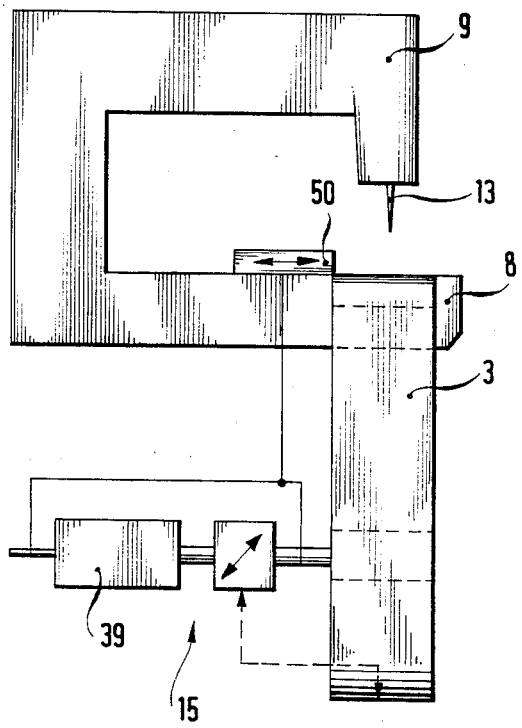
FIG. 4 is a simplified side view of the apparatus according to FIG. 3.
Figure 5:
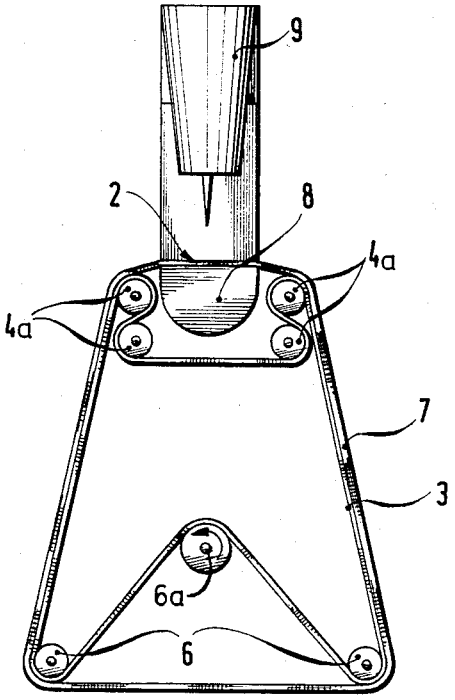
FIG. 5 is a simplified front view of the second embodiment of the apparatus in which the non-stationary rollers are movable towards the sewing area.

As already mentioned, the embodiment according to FIGS. 3 and 4 uses a slider 32 which is connected to the driving pulley 6*a*. The radial movement of the other rollers 6 towards and away from the point of reference is principally known from the German patent application P No. 33 12 317.9 and the prior U.S. application and is thus not explained in detail.

Figure 9:
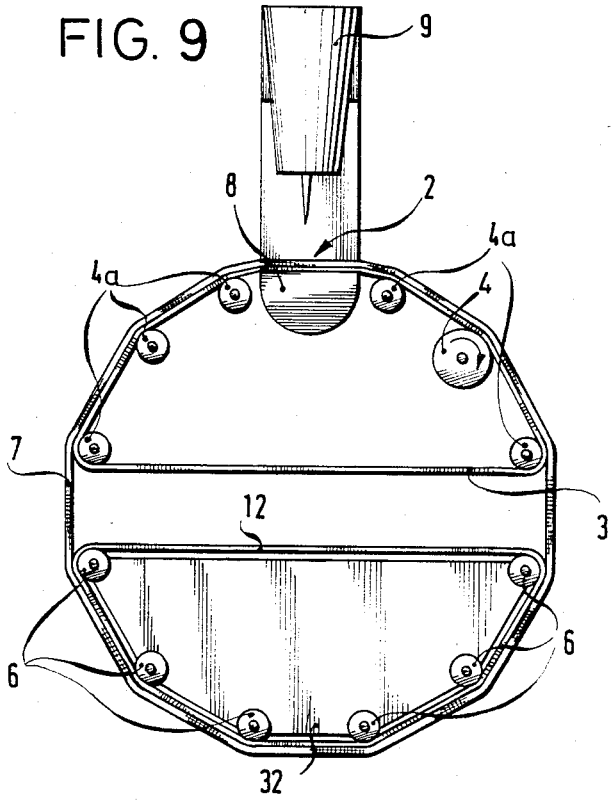
FIG. 9 is a simplified front view of the fourth embodiment in connection with a two-needle sewing machine.
Figure 10:
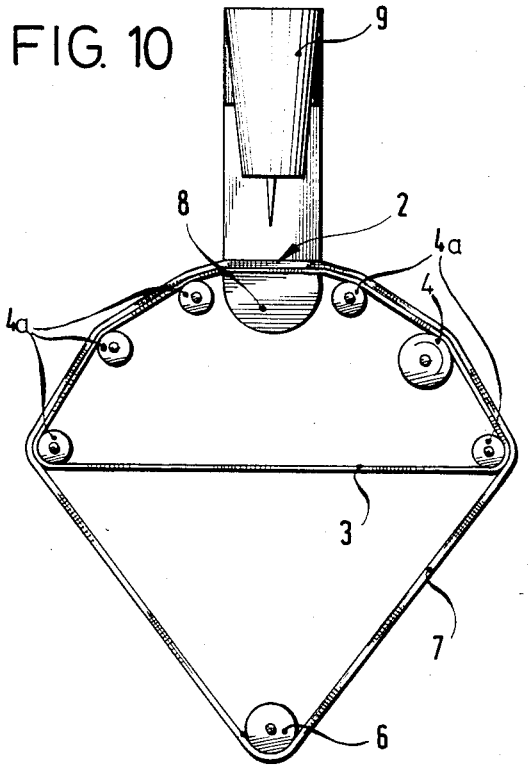
FIG. 10 is a simplified front view of the third embodiment in connection with a two-needle sewing machine.

Turning now to FIGS. 9, 10 there is shown a sewing machine 9 provided with two sewing needles 13 and 14. In order to allow a simultaneous sewing of the seams A and B onto the article 7, the conveyor belt 3 runs between the needles 13, 14.

Although, it is preferred to provide the rollers 6 at a distance below the rollers 4, it is also feasible—as shown in FIG. 1—to employ two rollers 4, 6 arranged side-by-side whereby one of the rollers, in the present case roller 4 is driven.

We claim:

1. Apparatus for tensioning and controlled transporting of a tube-like article to be sewed and having a variable waist size, comprising:

a support;

first stationary conveying means on said support and supporting part of the article in a sewing area;

second conveying means arranged on said support at a distance from said first conveying means for supporting another part of the article;

shifting means on said support for moving said second conveyor means with respect to said first conveying means so that a waist of the article provided over said first and second conveying means is tensioned when said shifting means moves said second conveying means away from said first conveying means and occupies a corresponding position;

driving means for advancing one of said first and second conveying means once said second conveying means is moved away from said first conveying means; and control means for actuating said driving means in such a manner that the speed of said one of said first and second conveying means is in dependence upon the instantaneous position occupied by said shifting means.

2. Apparatus as defined in claim 1 wherein said shifting means includes a slider connected to said second conveying means, and an operating cylinder under the influence of a pressure medium and acting on said slider to move the latter and said second conveying means relative to said first conveying means.

3. Apparatus as defined in claim 2 wherein said control means includes a control gear, an electromotor connected to said control gear and provided with an angle decoder for generating an output representing the orientation of said control gear, and a crank gear having one end connected to said control gear and another end connected to said slider so that the output of said angle decoder is dependent on the instantaneous position occupied by said slider.

4. Apparatus as defined in claim 3 wherein said crank gear includes a crank connected to said control gear, a connecting rod having one end hinged to said crank, a rocker having one end hinged to the other end of said rod, and a lever having one end hinged to the other end of said rocker and another end connected to said slider via a joint.

5. Apparatus as defined in claim 3 wherein said driving means includes a first belt pulley connected to the output end of said control gear, a second belt pulley associated to said one of said first and second conveying means, and an endless belt connecting said first and second belt pulleys for transmitting the output of said control gear onto said one conveying means.

6. Apparatus as defined in claim 2 wherein said control means includes a displacement transducer detecting the position of said slider and providing corresponding values, a microcomputer associated to said transducer and converting the values provided by said transducer into rotation angle values, and an electromotor associated to said microcomputer and controlled by the latter in accordance with the rotation angle values.

7. Apparatus as defined in claim 1 wherein said first conveying means includes at least one stationary roller and said second conveying means includes at least one roller, said rollers directly supporting the waist of the article.

8. Apparatus as defined in claim 1, further comprising an endless belt, said first conveying means including a plurality of stationary rollers in vicinity of the sewing area and said second conveying means including a plurality of rollers movable relative to a reference point, said belt running along said rollers of said first and second conveying means to support said waist of the article.

9. Apparatus as defined in claim 8 wherein one of said rollers of said second conveying means is connected to said driving means.

10. Apparatus as defined in claim 1 wherein said first conveying means includes a plurality of rollers and an endless belt running along said rollers, said second conveying means including at least one roller so that the waist of the article is partly supported by said belt and partly by said roller of said second conveying means.

11. Apparatus as defined in claim 1 wherein said first conveying means includes a plurality of rollers and an endless belt running along said rollers, and wherein said second conveying means includes a plurality of rollers and an endless belt running along said rollers of said second conveying means, said belts supporting the waist of the article.

12. Apparatus as defined in claim 1 wherein said first conveying means includes at least one roller and wherein said second conveying means includes a plurality of rollers and an endless belt running along said rollers of said second conveying means, said waist of the article being supported partly by said belt and partly by said roller of said first conveying means.

13. Apparatus as defined in claim 1, further comprising a sewing machine, said first conveying means including a plurality of rollers and an endless belt running along said rollers and in between two sewing needles of said sewing machine.

14. The apparatus defined in claim 1 wherein each of said conveying means comprises a plurality of rollers and respective belts passing around said rollers whereby said belts support both of said parts of said article.

* * * * *